United States Patent [19]

Shoji et al.

[11] Patent Number: 4,662,311

[45] Date of Patent: May 5, 1987

[54] DEVELOPING DEVICE

[75] Inventors: Yoshio Shoji; Kazuo Terao; Akihiko Noda; Takashi Yamamuro; Takayuki Sunaga, all of Ebina, Japan

[73] Assignee: Fuji Xerox Company, Limited, Tokyo, Japan

[21] Appl. No.: 821,958

[22] Filed: Jan. 24, 1986

[30] Foreign Application Priority Data

Mar. 28, 1985 [JP] Japan ..... 60-61887

[51] Int. Cl.[4] ..... G03G 15/06; G03G 15/09

[52] U.S. Cl. ..... 118/651; 118/658

[58] Field of Search ..... 118/651, 658

[56] References Cited

U.S. PATENT DOCUMENTS 2,297,791 3/1942 Ness .
2,895,847 6/1959 Mayo .
3,866,574 9/1975 Hardennrook et al. .
3,890,929 5/1975 Walkup .
3,893,418 1/1975 Liebman et al. .
4,407,228 10/1983 Takano et al. ..... 118/651
4,521,098 6/1985 Hosoya et al. ..... 118/651 X
4,528,936 6/1985 Shimazaki et al. ..... 118/651 X
4,579,081 4/1986 Kohyama ..... 118/651

*Primary Examiner*—Bernard D. Pianalto
*Attorney, Agent, or Firm*—Bachman & LaPointe

[57] ABSTRACT

A device for developing an electrostatic latent image recorded on a photoconductive layer. The developing device comprises a doner roll for supporting a uniform layer of single-component developing material adjacent to the photoconductive layer. The doner roll is disposed as to create a space gap between the photoconductive layer and the doner roll. The doner roll is made of semiconductive material having a specific resistance ranging from $10^6$ to $10^{12}$ Ωcm. An electrical bias potential is applied across the gap, thereby establishing a field for transferring the developing material from the doner roll to the photoconductive layer.

4 Claims, 13 Drawing Figures

DEVELOPING DEVICE

BACKGROUND OF THE INVENTION

This invention relates to a device using single-component developing material for developing an electrostatic latent image recorded on a photoconductive layer.

In the art of xerography as discussed in U.S. Pat. No. 2,297,991 to Carlson, a xerographic plate, which comprises a layer of photoconducting and insulating material on a conducting backing, is given a uniform electric charge over its surface and is then exposed to the subject matter to be reproduced. This exposure results in discharge of the photoconductive plate whereby an electrostatic latent image is formed. The latent charge pattern is developed or made visible with a charged powder. Thereafter, the developed image is transferred to a support member to which it is fixed. Controlled development of electrostatic latent image can be accomplished by several techniques including cascade, magnetic-brush, liquid-dispersion development, etc. Another important development technique is called as "transfer development" which is, for example, disclosed in U.S. Pat. No. 2,895,847 to Mayo. This development process employs a support member such as a "donor" which carries a layer of toner particles to be brought into close contact with the electrostatic latent image to be developed.

It is to be noted that the term "transfer development" is generec to development techniques where (1) the toner layer is out of contact with the photoconductor and the toner particles must traverse an air gap to effect development, (2) the toner layer is brought into rolling contact with the photoconductor to effect development, and (3) the toner layer is brought into contact with the imaged photoconductor and skidded across the imaged surface to effect development. Transfer development has also come to be known as "touchdown development".

A serious problem which occurs with transfer type development is fog or background development. In order to minimize background development, there is proposed, in U.S. Pat. No. 2,289,400 to Moncrieff-Yeates, an out of contact transfer development system in which toner particles tranverse an air gap between the doner and the xerographic plate to develop the electrostatic latent image disposed on the xerographic plate. However, the special positioning of the doner and the xerographic plate in relation to each other is critical. For example, the length of the air gap or development gap must be adjusted at a value less than 0.05 mm and preferably less than 0.03 mm. This adjustment involves considerable difficulty in maintaining the xerographic plate and the doner within the required range of mechanical accuracy. Several attempts have been made to overcome the difficulty. For example, in U.S. Pat. Nos. 3,866,574 to Hardennrock, 3,890,929 to Walkup, and 3,893,418 to Liebman, a pulse generator source is employed for applying pulsed bias potentials to create electrical fields across the air gap between the toner carrier member and the latent image bearing member. Particularly, the Hardennrock patent discloses that optimum line development is effected with a minimum of background deposition when the three conditions are established, that is, when the air gap length (g) is in the range of 0.05 mm to 0.18 mm, the AC electric voltage frequency (f) is in the range of 1.5 kHz to 10 kHz, and the pulsed bias potential ($V_{p-p}$) is less than 800 volts.

Furthermore, the conventional transfer type development systems as disclosed in the Hardennrock patent utilize the electrostatic forces of the latent image to overcome the carrier-toner bond and attract toner particles onto the image areas. The toner can transfer from the doner to the image areas on the xerographic plate across the air gap when the intensity of electrostatic forces associated with the latent image exceeds a threshold value which may be referred to as toner transfer threshold value. Although the toner bonding forces vary from one toner particle to another due to the dispersion of physical and chemical properties of the individual toner particles, they are distributed in a narrow range around a fixed value. Consequently, development is effected in such binary form fashion that toner particles are deposited on the image areas producing electrostatic forces exceeding the toner transfer threshold value, while no toner particle is deposited on the areas producing electrostatic forces less than the threshold value. In other words, the characteristic curve representing image density with respect to surface potential has such a great gradient ($\gamma$) as to cause poor continuous-tone development. In addition, the characteristic curve has such a great gradient ($\gamma$) as to allow only a part of toner particles to traverse the air gap if the amplitude of the pulsed bias potential ($V_{p-p}$) is less than 800 volts even though the toner bonding forces are distributed in a wide range.

Japanese Patent Publication No. 58-32375 discloses a transfer type development method which improves the quality in continuous tone images by applying a low-frequency bias voltage to create alternative electric fields across the air gap between the toner carrier and the xerographic plate. The toner transfers from the toner carrier to the xerographic plate during one half cycle of applied voltage, this cycle being termed to toner transfer cycle. The toner transfers back to the toner carrier from the xerographic plate during the second cycle which is termed to toner counter-transfer cycle. The Japanese Publication describes that the quality of continuous tone images can be improved to a considerable extent by repetitive transfer and counter-transfer cycles when the applied bias voltage is at a frequency lower than 1 kHz, while the effect is diminished when the biase voltage frequency is higher than 2 kHz. It is considered that application of low-frequency bias voltage to create alternative electrical fields across the air gap is effective to deposite toner particles on image areas in conformity with the latent image pattern with high fidelity to its surface potentials in the case where the toner bonding forces are distributed in such a narrow range as to effect binary-form development. However, the development method disclosed in he Japanese Publication is disadvantageous in that (1) the forces produced by the electrical fields associated with the image and non-image areas are not different on the toner carrier and (2) dot or screen pattern images cannot be reproduced with high fidelity since toner particles do not transfer along the electrical force lines, resulting in low resolution.

Therefore, the present invention provides an improved developing device which can achieve an excellent reproduction of dot or screen pattern images without degrading the quality of reproduction of line and solid images.

SUMMARY OF THE INVENTION

There is provided, in accordance with the present invention, a device for developing an electrostatic latent image recorded on a photoconductive layer. The developing device comprises a doner roll for supporting a uniform layer of single-component developing material adjacent to the photoconductive layer. The doner roll is disposed as to create a space gap between the photoconductive layer and the doner roll. The doner roll is made of semiconductive material having a specific resistance ranging from $10^6$ to $10^{12}$ Ωcm. An electrical bias potential is applied across the gap, thereby establishing a field for transferring the developing material from the doner roll to the photoconductive layer.

According to the present invention, fringing fields are produced at the boundary of an electrostatic latent image in order to reproduce both dot or screen pattern images and line images with high fidelity. Since substantially no fringing field occurs at the boundary of an electrostatic latent image if the air gap between the development electrode and the xerographic plate (photoconductive layer) has a minute length (100 to 500 μm), the development electrode must be separated a substantial distance from the xerographic plate. However, separation of the development electrode from the photoconductive layer would cause electrical discharge between the development electrode and the photoconductive layer and toner particles would get a relatively great kinetic energy so that toner particles cannot move along the electrical force lines, causing deposition of toner particles on the non-image areas. According to the present invention, this problem is eliminated by placing an electrical resistive layer (doner roll) on the development electrode in such a fashion as to increase the electrical length of the space between the development electrode and the xerographic plate and at the same time decrease the electrical length of the space between the xerographic plate and the toner to produce fringing fields at the boundary of the electrostatic latent image. It is desirable that the resistive layer placed on the development electrode has a specific resistance ranging from $10^6$ to $10^{12}$ Ωcm. If it is smaller than this range, no fringing field occurs at the boundary of the image areas. If it is greater, the contrast of field intensities and thus the density of the center portion of the image area are too low.

A high-frequency AC bias potential may be applied across the gap between the doner roll and the photoconductive layer in order to facilitate transfer of toner particles from the doner roll to the photoconductive layer. It is desired that the AC bias potential has a frequency ranging from 1 to 10 kHz, preferably from 1 to 3 kHz, and an amplitude ranging from 400 to 4500 volts, preferably from 800 to 2500 volts.

Since the charges on conventional single-component developing material are distributed in a relatively narrow range, there is a clear toner transfer threshold value, causing development effected in binary form or on-off fashion when the developing material is used for out of contact transfer development. According to the present invention, the toner particle charges are distributed in such a wide range as to achieve an excellent continuous tone development. In this case, the desirable toner charge distribution has a variance of ±15 μC/g.

BRIEF DESCRIPTION OF THE DRAWINGS

The present invention will be described in greater detail by reference to the following description taken in connection with the accompanying drawings, in which.

DETAILED DESCRIPTION OF THE PREFERRED EMBODIMENTS

Prior to the description of the preferred embodiments of the present invention, the serious problems which occur with the transfer type development method disclosed in Japanese Patent Publication No. 58-32375 will be described with reference to FIGS. 1 and 2 for a better understanding of the present invention.

One problem with the prior art out of contact transfer development method is in that the electrical forces cannot be resolved on the xerographic plate so that the image and non-image areas have the same potential when the electrostatic latent image has a high spatial frequency if the gap between the xerographic plate and toner carrier has a length greater than 0.1 mm. In other words, narrow line images or dot pattern images collapse. The image collapse problem will be described in connection with a value M which is used to indicate the degree of collapse and is given as:

$$M = \frac{1 - 10^{-\Delta D}}{1 + 10^{-\Delta D}}$$

where ΔD is the difference in image density between the image and non-image areas.

Figure 1:
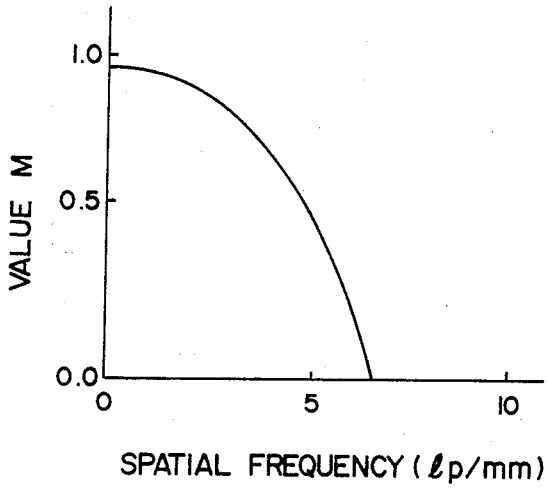
FIG. 1 is a graph of spatial frequency versus value M.
Figure 2:
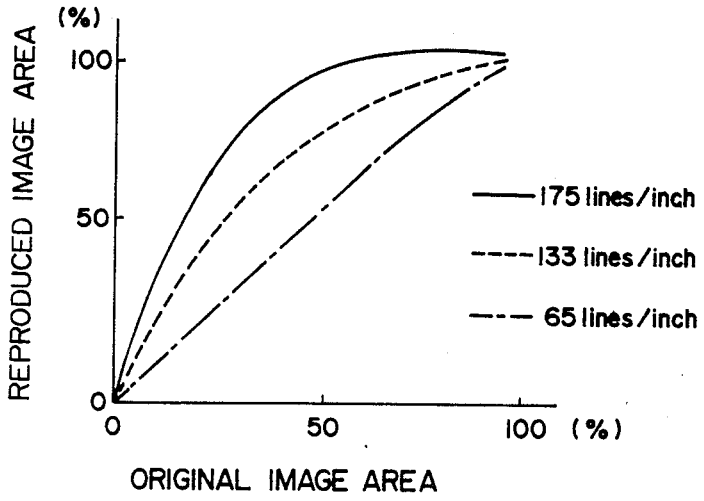
FIG. 2 is a graph of original image area versus reproduced image area for different spatial frequencies.

It can be seen from FIG. 1, which shows the value M in relation to the spatial frequency, that the resolution of an electrosttic latent image formed on the xerographic plate is still high with a spatial frequency of 5 lines/mm, while the resolution thereof is rather low for a spatial frequency of 6 lines/mm. It was found from microphotographs that image collapse results in a reduction of the value M. As shown in FIG. 2, collapse occurs for a dot or screen pattern image to produce a deviation between the original and reproduced images with a spatial frequency of 65 lines/mm. As a result, the image resulting from development of a dot or screen pattern image having a great number of lines is dark over its whole area and is unclear with low contrast. In order to overcome this problem, the inventors conducted experiments using the development method disclosed in Japanese Patent Publication No. 58-32375. The result is that the quality of the continuous tone images are improved to a considerable extent and the images are reproduced with higher fidelity to the surface potential on the xerographic plate, while this advantageous effect is obtained only for a spatial frequency higher than 65 lines/mm.

The reason for this is that collapse occurs on dot or screen pattern images because the electrical fields produced by the electrostatic latent image has poor fidelity to the latent image so that the force of the electrical fields associated with the image and non-image areas are the same on the photoconductor, that is, there is no contrast in the electrical fields rather than because the development is effected in binary form with a great gradient ($\gamma$).

When the toner carrier does not have a proper resistivity and thickness, for example, when it is a normally used metal sleeve, no contour electrical field occurs in association with the image periphery at a position near the xerographic plate. Consequently, toner particles transfer towards the image and non-image areas without clear distinction and get kinetic energy in the development gap to fly away from the electrical force lines so that a part of toner particles are deposited on the non-image areas.

Figure 3:
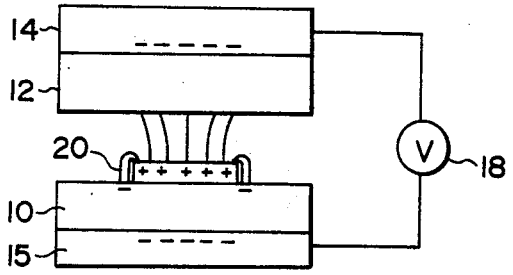
FIG. 3 is a schematic view used in explaining the principles of the present invention.

The principles of the present invention will be described with reference to FIGS. 3 to 9. Referring to FIG. 3, which is a schematic view showing the contour of the electrical field in the region of an electrostatic latent image formed on a xerographic plate.

The xerographic plate comprises a photosensitive insulating layer 10 placed on a conductive substrate 15. Arranged in spaced relation to the xerographic plate is a toner carrier 12 of a resistance material. A development electrodes 14 is placed in contact with the toner carrier 12. An alternative voltage source 18 is connected to apply a high-frequency AC bias voltage between the development electrode 14 and the conductive substrate 15.

Various controlled parameters are set to control the electrical fields produced by the latent image on the xerographic plate so as to produce fringing fields at the boundary of the latent image, permitting high quality reproduction of dot or screen pattern images and minute reproduction of line images with high fidelity. These controlled parameters include the resistance, thickness and dielectric constant of the toner carrier 12, and the distance between the photoconductive insulating layer 10 and the toner carrier 12.

Figure 4:
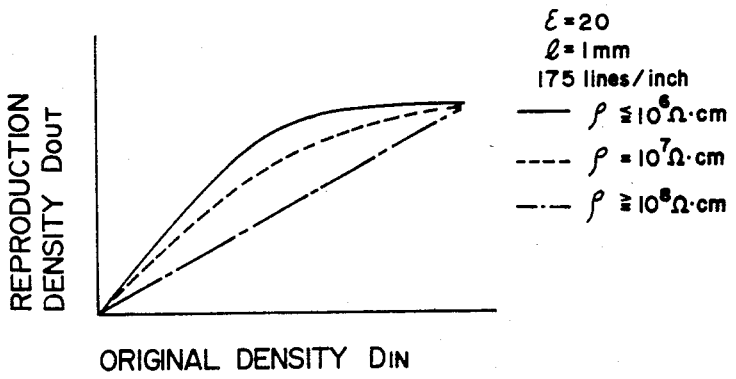
FIG. 4 is a graph showing the quality of reproduction of dot or screen pattern images for different toner carrier specific resistances.

FIG. 4 shows three different reproduction curves of reproduction density vs. original density for different specific resistances. The fidelity of reproduction of a dot or screen pattern image to an original image of 175 lines per inch was tested with a toner carrier having a thickness (l) of 1 mm and a dielectric constant ($\epsilon$) of 20, that is, a dielectric thickness ($l/\epsilon$) of $5\times10^{-5}$ m. The reproduction fidelity will be at a maximum with no image collapse when the gradient of the reproduction curve is 1. It can be seen that for a specified resistance less than $10^6$ Ωcm, the reproduction curve curves at a high value of original density, as indicated by the solid curve of FIG. 4. This represents occurrence of collapse on the image areas, resulting in a so-called "dark image". For a specified resistance of $10^7$ Ωcm, the reproduction curve gets close to a line, as indicated by the broken line of FIG. 4. When the specific resistance is greater than $10^8$ Ωcm, a linear relationship is established between the reproduction density (Dout) and the original density (Din), as indicated by the one-dotted line of FIG. 4. When the gradient of the reproduction curve is substantially 1, the dot or screen pattern image was reproduced with high fidelity and high resolution.

Figure 5:
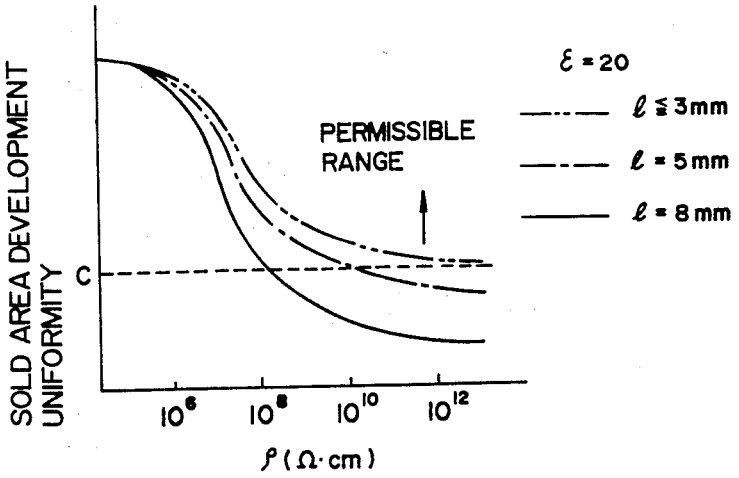
FIG. 5 is a graph of specific resistance versus solid development uniformity for different toner carrier thicknesses.

If the toner carrier layer has an excessively great thickness, the fringing fields at the boundary of the electrostatic latent image will be intensified to such an extent as to degrade the uniformity of development of the solid black areas. FIG. 5 illustrates the results of a series of solid area development uniformity tests, where the solid curve relates to a toner carrier thickness (l) of 8 mm (or toner carrier dielectric length ($l/\epsilon$) of $4.0\times10^{-4}$ m), the one-dotted curve relates to a toner carrier thickness of 5 mm (or toner carrier dielectric length of $2.\times10^{-4}$ m), and the two-dotted curve relates to a toner carrier thickness less than 3 mm (or toner carrier dielectric length less than $1.5\times10^{-4}$ m). In FIG. 5, the point C indicates a limit above which the uniformity of development of solid black areas is permissible. It can be seen from these test results that, for a toner carrier thickness less than 3 mm, uniform development of solid black areas can be achieved when the toner carrier specific resistance is in the range of $10^6$ to $10^{12}$ Ωcm. For a toner carrier thickness of 5 mm, solid black areas can be developed with permissible uniformity when the specific resistance of the toner carrier layer is less than $10^{10}$ Ωcm. With the toner carrier thickness of 8 mm, solid black areas can be developed with permissible uniformity when the toner carrier specific resistance is less than $10^8$ Ωcm. Various tests show that both high quality development of dot or screen pattern images and uniform development of solid black areas can be achieved when the specific resistance ($\rho$) of the toner carrier layer is in the range of $10^6$ to $10^{12}$ Ωcm and when the dielectric length of the toner carrier layer is less than $4.0\times10^{-4}$ m.

Figure 6:
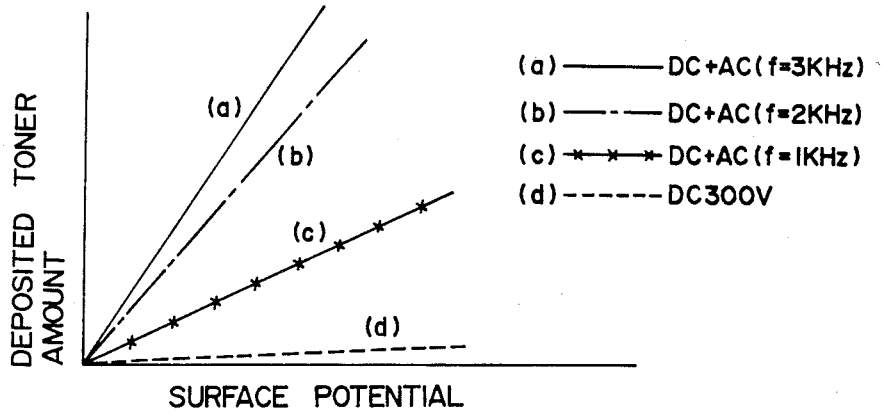
FIG. 6 is a graph showing the amount of toner deposited on the xerographic plate as a function of xerographic plate surface potential.

FIG. 6 illustrates the results of toner deposition tests for different development bias voltage sources connected to the development electrode. Line (a) relates to a bias voltage of a 300 volt DC voltage superposed on a 2000 volt AC voltage having a frequency of 3 kHz, line (b) relates to a bias voltage of a 300 volt DC voltage superposed on a 2000 volt AC voltage having a requency of 2 kHz, and line (c) relates to a bias voltage of a 300 volt DC voltage superimposed on a 2000 volt AC voltage having a frequency of 1 kHz. Line (d) relates to a bias voltage of a 300 volt DC voltage. Application of a 300 volt DC voltage is effective to prevent toner deposition on the non-image areas. In these tests, the development gap length was 150μ, the toner carrier specific resistance ($\rho$) was 10 Ωcm, the toner carrier thickness (l) was 1 mm, the toner carrier dielectric constant ($\epsilon$) was 20, and the xerographic plate background potential was 250 volts. With a 300 volt DC bias voltage applied to the development electrode, substantially no toner could traverse the development gap, as shown by line (d). Lines (a), (b) and (c) indicate that the amount of toner particles deposited on the image areas is in a linear relationship to the xerographic plate surface potential, that is, the electrostatic latent image can be developed with high fidelity, when the bias voltage comprises a 300 volt DC voltage superposed on a 2000 volt AC voltage having a frequency ranging from 1 kHz to 3 kHz. As can be seen from FIG. 6, the gradient ($\gamma$) of the toner deposition lines is dependent upon the frequency of the AC voltage component of the bias voltage applied to the development electrode. High quality development was achieved for an AC bias voltage frequency higher than 1 kHz, although the toner cannot move in response to the bias voltage application when the AC bias voltage frequency is higher than 10 kHz. It is therefore considered that the upper limit of the AC bias voltage frequency is 10 kHz.

Figure 7:
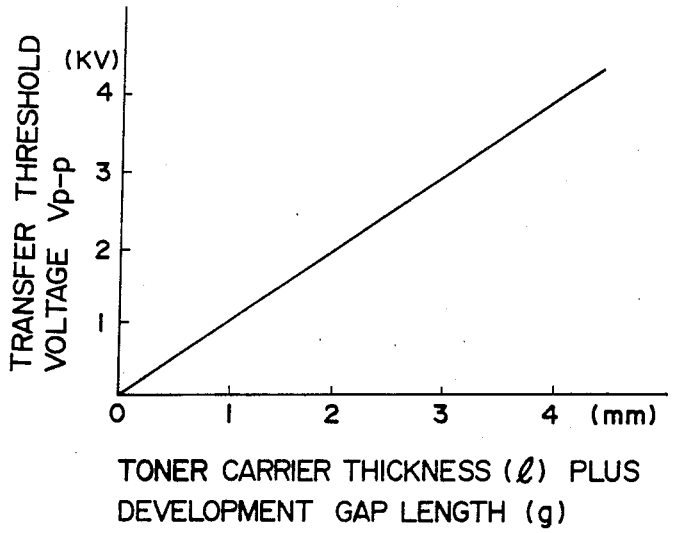
FIG. 7 is a graph of toner carrier thickness plus development gap length versus toner transfer threshold AC voltage.

FIG. 7 illustrates that peak-to-peak voltage ($V_{p-p}$) of the AC bias voltage, which is required to overcome the carrier-toner bond and deposite toner particles on the xerographic plate, in connection with the carrier thickness (l) plus the development gap length (g). In the tests, the toner carrier specific resistance ($\rho$) was $10^{10}$ Ωcm, the toner carrier dielectric constant ($\epsilon$) was 20, the xerographic plate background potential was 250 volts, and the applied AC bias voltage frequency was 2 kHz. It can be seen from FIG. 7 that the AC bias voltage is required to have a peak-to-peak voltage ($V_{p-p}$) greater than 400 volts when the toner carrier thickness (l) is 20 μm and the development gap length is 80 μm, a peak-to-peak value greater than 1000 volts when the sum of the toner carrier thickness and the development gap length is 1 mm, and a peak-to-peak value greater than 3000 volts when the sum of the toner carrier thickness and the development gap length is 3 mm. Although the required peak-to-peak value ($V_{p-p}$) is also dependent upon the toner carrier specific resistance ($\rho$), the toner carrier dielectric constant ($\epsilon$) and the AC bias voltage frequency (f). It may be said that toner particles can traverse the development gap if the AC bias voltage peak-to-peak value ($V_{p-p}$) is in the range of 400 to 4500 volts, preferably in the range of 800 to 2500 volts.

Figure 8:
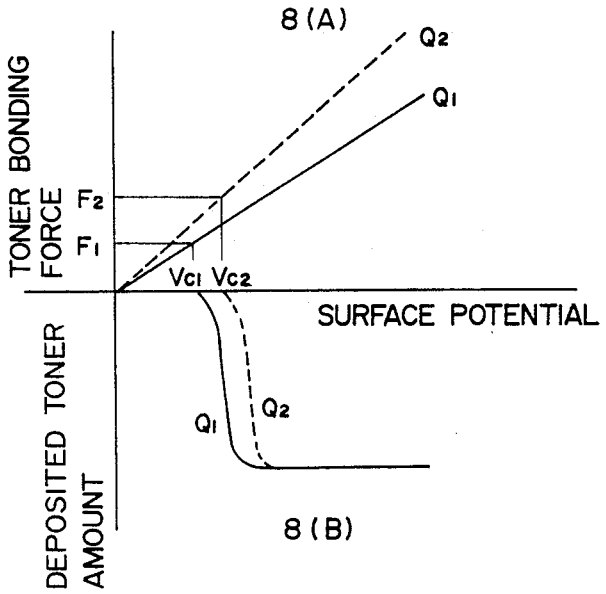
FIG. 8A is a graph of surface potential versus toner bonding force for different toner charges.
FIG. 8B is a graph of surface potential versus deposited toner amount for different toner charges.
Figure 9:
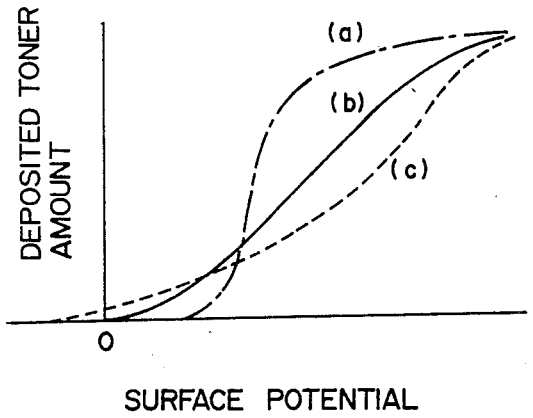
FIG. 9 is a graph of surface potential versus deposited toner amount for different toner charge distribution variances.

The quality of reproduction of continuous tone images is improved by distributing the quantity of electrical charges on the toner in a wider range. FIG. 8A illustrates the relationship between the xerographic plate surface potential and the force bonding toner particles on the toner carrier, and FIG. 8B illustrates the relationship between the xerographic plate surface potential and the amount of toner deposited on the xerographic plate. The problem which occurs with the out of contact transfer type development as disclosed disclosed in U.S. Pat. No. 3,866,574 is that development is effected in an on-off fashion with a great gradient ($\gamma$) of the characteristic curve representing image density with respect to surface potential. This problem will be described with reference to FIG. 8. Assuming now that the charge on the toner is Q1 and the xerographic plate surface potential is V, the intensity of the electrostatic forces acting on the toner is in direct proportion to the product Q1×V of the toner charge Q1 and the surface potential V. On the other hand, the electrical force bonding the toner on the toner carrier (development resistance) is in direct proportion to the square of the toner charge Q1. Toner particles are deposited on the xerographic plate at points having a potential greater than a threshold value Vc at which the electrostatic force acting on the toner overcomes the electrical force bonding toner particles on the toner carrier. As a result, development is effected in an on-off fashion with a great gradient ($\gamma$). That is, assuming that, in FIG. 8A, F1 is the force bonding the toner having a charge Q1 on the toner carrier, toner particles, which have a charge Q1, will traverse the development gap when the xerographic plate surface potential is greater than a threshold value Vc1, whereas toner particles, which have a charge Q2 greater than the charge Q1, will traverse the development gap when the xerographic plate surface potential is greater than a threshold value Vc2 greater than Vc1. The charges Q on conventional one-component developer particles are distributed in a relatively narrow range, resulting in development effected in on-off fashion with a great gradient. Japanese Patent Publication No. 58-32375 discloses a method which can improve the on-off type development, that is, the quality of halftone reproduction by applying a low-frequency alternating voltage to repeat two cycles of operation. During one cycle, the toner transfers from the toner carrier to the xerographic plate. During the second cycle, the toner is transferred back from the xerographic plate to the toner carrier. On the other hand, since the present invention, which adjusts the intensity of the development electrical fields in accordance with developer carrier resistance, developer carrier thickness, developer carrier dielectric constant, and development gap length, requires a high-frequency alternating bias voltage, it is impossible to improve the continuous tone development in the conventional manner. In the present invention, therefore, the charges on toner particles are distributed in a proper wide range so that the development threshold potential values Vc can be distributed in a proper wide range to improve the conventional development effected in an on-off fashion. In FIG. 9, curve (a) relates to the case where the toner particle charges are distributed with a variance of ±3 μC/g around an average charge Q, that is, the gradient ($\gamma$) is great, and curve (b) relates to the case where the toner charges are distributed with a variance of ±15 μC/g and exhibits excellent continuous tone development.

On the other hand, curve (c) relates to toner charge distribution with a variance of ±20 μC/g and illustrates that the minimum or threshold value of the xerographic plate surface potential at which toner particles are deposited on the xerographic plate is negative, causing fog or background development. The fog problem occurs due to toner particles charged in the opposite polarity. Test results show that the fog or background development problem occurs when the toner particles charged in the positive polarity are distributed with a variance of ±10 μC/g or more. It is desired that toner particles charged in the opposite polarity are distributed with a variance of ±15 μC/g.

The basic structure of the developing device of the present invention comprises a hopper for containing a single-component toner, a toner carrier mounted on a shaft for rotation near an electrostatic latent image bearing member, the toner carrier being made of a semiconductive material having a specific resistance ranging from $10^6$ to $10^{12}$ Ωcm, a magnet roller secured within the toner carrier, the magnet roller having a plurality of magnetic polarities, a toner metering means for metering the amount of toner deposited on the toner carrier, and an AC power source electrically connected to the toner carrier. In a preferred embodiment, the toner carrier has a thickness ranging from 0.5 to 5 mm, preferably from 1 to 2 mm. The toner carrier is made of phenolic plastic having a specific resistance ranging from $10^6$ to $10^{12}$ Ωcm. The surface of the toner carrier is polished longitudinally to a predetermined roughness for carrying toner particles thereon. The toner metering member is positioned just above the toner carrier for metering the amount of toner on the toner carrier. The toner metering member may be a non-magnetic leaf spring having a resilient member secured thereon by thermocompression bonding, the resilient member having a thickness ranging from 0.1 to 3 mm, preferably from 0.5 to 1.5 mm and a hardness ranging from 30° to 70° and preferably from 40° to 60°. The resilient member is made of rubber, silicone rubber or the like. The resilient member is in contact with the semiconductive roller at a position corresponding to the magnetic pole of the magnet roller under a line pressure of 50 to 200 g/cm.

The following Examples further specifically define the surprisingly advantageous developing device of this invention. The parts and percentages are by weight unless otherwise indicated.

The Examples below are intended to illustrate various preferred embodiments of the improved developing device of this invention.

EXAMPLE 1

Figure 10:
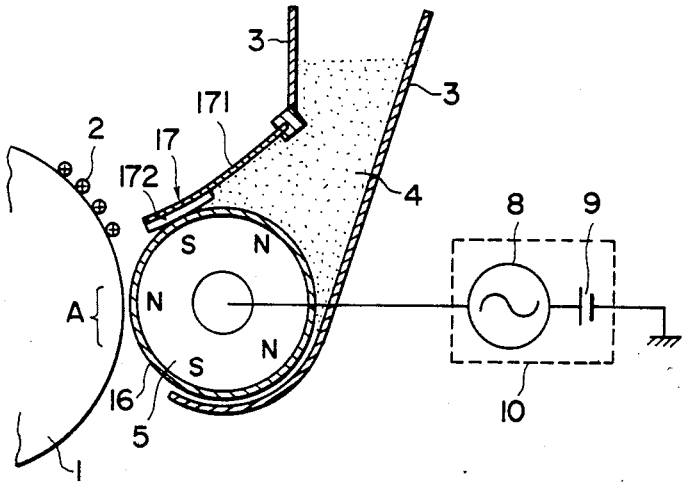
FIG. 10 is a schematic cross-sectional view showing one embodiment of a developing device made in accordance with the present invention.

Referring to FIG. 10, which is a schematic cross-sectional view of the developing device according to the present invention, a drum as a photosensitive surface 1 thereon bearing an electrostatic latent image. The drum may be rotated in a clockwise direction for predetermined processes to thereby produce an electrostatic latent image thereon, and then reaches the developing station. These processes may be accomplished in any suitable manner as well known in the art. For example, the photosensitive surface 1 is subject to an overall uniform distribution of electrical charges and then exposed to an optical image. The photosensitive surface 1 is shown as having an electrostatic latent image 2 carried thereon, the latent image corresponding to the dot or screen pattern of an original document. The initial surface potential as −900 volts and the background potential was −150 volts.

The developing station comprises a toner reservoir or hopper 3, a magnet roll 5 fixed to unshown opposite side plates, a semiconductor sleeve (toner carrier) 16 rotatably mounted in surrounding relation about the periphery of the magnetic roll surface, and a toner metering device 17. The hopper 3 has a supply of single-component magnetic developer 4 comprising toner particles. The toner is comprised of about 55% by weight of magnetic powder, about 22.5% by weight of dimethylamide methyl methacryulate (main binder), and about 22.5% by weight of a mixture of styrene butadiene and polyethylene wax. The magnetic roll 5 is magnetized to have a plurality of magnet segments N and S in such a way that respective adjacent magnet segments are of opposite polarity. The semiconductive sleeve 16, which is made of phenolic plastic having a specific resistance of $10^{10}$ Ωcm and a specific inductive capacity $\epsilon=20$, has a cylindrical form with a thickness of about 1.2 mm. The peripheral surface of the sleeve 16 is polished to a roughness Rz=10 μm. The toner metering device 17 comprises a leaf spring 171 made of non-magnetic stainless steel and a resilient member 172 secured on the leaf spring 171 by thermocompression bonding. The leaf spring 171 is secured at its one end to the hopper at such an angle that the leaf spring 172 can urge the resilient member 172 in contact with the semiconductor sleeve 16. The contact pressure is about 150 g/cm. The leaf spring 171 has a thickness of about 0.1 mm. The resilient member 172 is made of silicone rubber and it has a thickness of about 1 mm. The toner metering device 17 forms a uniform toner layer on the semiconductive sleeve 16. The reference numeral 10 designates a bias voltage source which comprises an AC voltage source 8 connected in series with a DC voltage source 9 for applying an AC voltage superposed on a DC voltage to the semiconductive sleeve 16.

The magnetic roll 5 creates fields between respective adjacent magnet segments to attract toner particles on the semiconductor sleeve 16 in the hopper 3. The toner bristles on the semiconductor sleeve 16 at positions corresponding to the magnetic segments of the magnet roll 5. Rotation of the semiconductive sleeve 16 permits the toner particles to be conveyed through the toner metering device 17. The toner metering device 17 has a resilient member 172 which engages in pressure contact with the semiconductive sleeve 16 to meter the toner is such a way as to form a uniform toner layer on the semiconductive sleeve 16 and also to triboelectrically charge the toner particles. When the toner reaches the development area A' in which the semiconductive sleeve 16 faces, with a development gap, to the photosensitive surface 1, the toner bristles again and comes close to the photosensitive surface 1 to permit toner particles to be transferred into contact with the photosensitive surface 1 where the greater electrostatic attraction of the latent image will overcome the attraction between the toner and the semiconductive sleeve 16, causing toner to be stripped off the semiconductive sleeve 16 and electrostatically bonded to the charged image to effect development thereof. The amount of toner particles forming the uniform toner layer was about 2.0 mg/cm$^2$.

The developing device was placed in a xerographic machine in such a manner as to provide a 300 μm gap between the semiconductive sleeve 16 and the photosensitive surface 1. The toner on the semiconductive sleeve was out of contact with the photosensitive surface 1. A bias voltage was applied from the bias voltage source 10 to the semiconductive sleeve 16. The frequency of the AC voltage applied from the AC voltage source 8 was about 2.4 kHz and the peak-to-peak voltage ($V_{p-p}$) thereof was about 2400 volts. The DC voltage applied from the DC voltage source 9 was about −250 volts. A very clean reproduction of the dot or screen pattern image was achieved from an original document.

Various dot pattern image reproduction tests have been performed for different semiconductive sleeve materials under the above conditions. It was found that an excellent image reproduction can be achieved when the specific resistance of the semiconductive sleeve material is in the range of $10^6$ to $10^{12}$ Ωcm.

EXAMPLE 2

Using the same developing device as described in connection with the first Example, various dot pattern image reproduction tests have been performed for different development gap lengths (g) and different AC voltage peak-to-peak values ($V_{p-p}$). It was found that the dot pattern image reproduction quality charges with sharp contrast on the opposite sides of each of two peak-to-peak voltage threshold lines each of which is represented as a linear function of development gap length (g).

Figure 11:
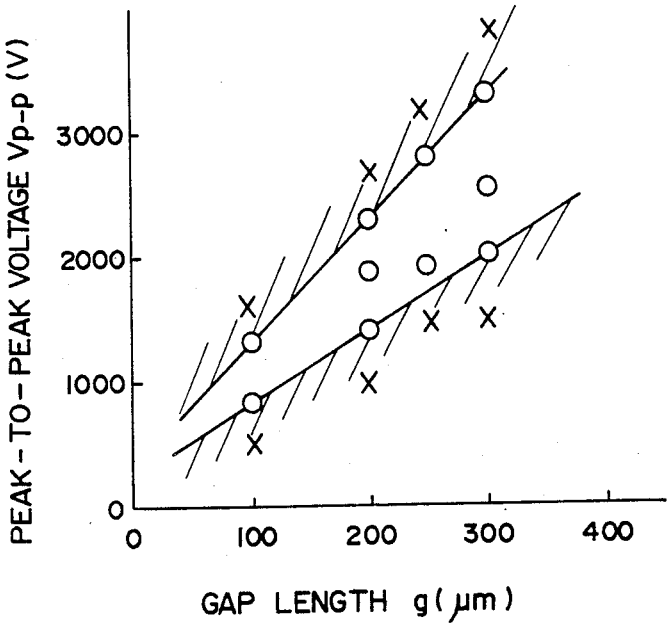
FIG. 11 is a graph showing the region in which an excellent dog or screen pattern image reproduction can be achieved.

FIG. 11 illustrates the results of the dot pattern image reproduction tests. In FIG. 11, marks x indicates the points at which the peak-to-peak values ($V_{p-p}$) are plotted against a development gap length (g) and they indicates the conditions resulting in poor dot pattern image reproduction. Marks o indicates the points at which the peak-to-peak value ($V_{p-p}$) are plotted against a development gap length (g) and they indicate the conditions resulting in an excellent dot pattern image reproduction. The upper line is represented as $V_{p-p}=10\ g+300$ and the lower line is represented as $6\ g+200$. It is, therefore, apparent that an excellent dot pattern image reproduction can be achieved by setting the peak-to-peak value ($V_{p-p}$) in the range of $6\ g+200$ to $10\ g+300$ if the development gap is set at a fixed value (g) for any of reasons. This facilitates the design of developing devices.

Various dot pattern image reproduction tests have also been performed for different AC voltage frequencies ranging from 1.0 to 3.0 kHz. It was found that the quality of reproduction of dot pattern images is independent of the frequency of the AC voltage applied from the bias voltage source 10 to the semiconductive sleeve 16 in this frequency range.

EXAMPLE 3

Figure 12:
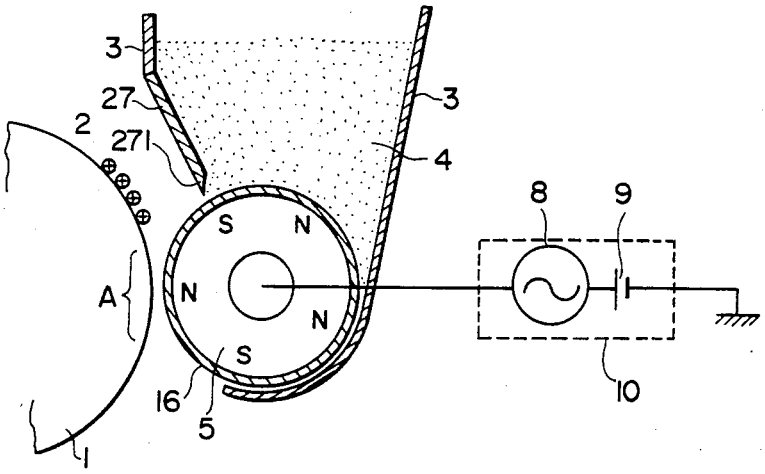
FIG. 12 is a schematic cross-sectional view showing another embodiment of the present invention.

Referring to FIG. 12, which is a schematic cross-sectional view of a modified form of developing device of the present invention. Like reference numerals have been applied to the components which are similar to those of FIG. 10. The developing device is substantially the same as that described in connection with the first Example except that the structure of the toner metering device. In this example, the toner metering device comprises a magnetic trimmer 27 made of ferromagnetic material. The magnetic trimmer 27 is formed at its tip end with a slant surface to provide a sharp edge 271 extending in parallel with the magnet segments of the magnetic roll 5. The magnetic trimmer 27 is secured at the other end thereof to the hopper 3 in such a fashion that the trimmer edge 271 faces to the semiconductive sleeve 16 with a uniform gap. The trimmer edge 271 is magnetized. The length of the uniform gap between the magnetic trimmer 27 and the semiconductive sleeve 16 is 0.6 mm. Since there are produced uniform force lines in the uniform gap, the amount of toner passing the gap to the development area A remains constant.

Using this developing device placed in a xerographic machine, various dot pattern image reproduction tests have been performed in the same manner as described in connection with the first Example. During these tests, an excellent reproduction of dot pattern images was achieved.

Although the present invention has been described in connection with the use of magnetic toner, it is to be noted that the use of the magnet roll 5 fixed within the semiconductor sleeve 16 permits selective use of magnetic toner for reproduction of black images and non-magnetic toner, which has a high degree of transparency, for reproduction of bright color images.

EXAMPLE 4

Using red-color non-magnetic toner in the same developing devices as described in connection with the first and third Examples except that the peak-to-peak voltage ($V_{p-p}$) of the AC voltage applied from the AC voltage source 8 is about 2500 volts and the DC voltage applied from the DC voltage source 9 is about $-350$ volts, various dot pattern image reproduction tests have been performed. During these tests, an excellent reproduction of dot pattern images was achieved.

Figure 13:
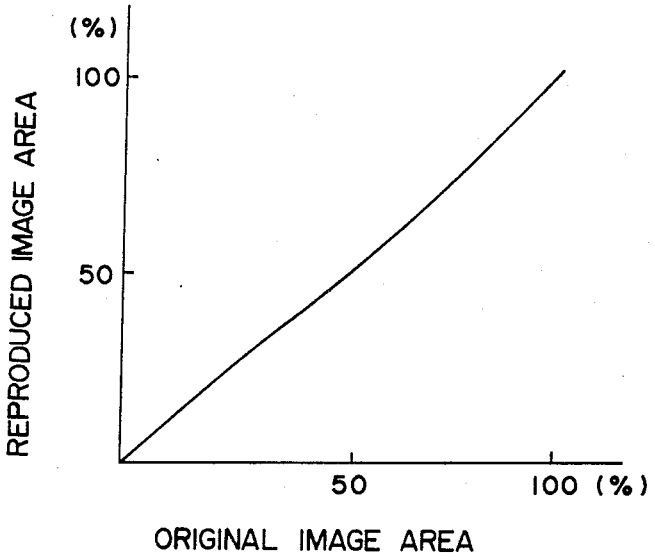
FIG. 13 is a graph of original image area versus reproduced image area.

In Examples 1 to 4, the charges Q on toner particles were measured. It was found that the toner charges Q are distributed in a wide range with a variance ranging from $-5\ \mu C/g$ to $25\ \mu C/g$. As shown in FIG. 13, the present invention can achieve an excellent reproduction of dot or screen pattern images with high fidelity.

It is, therefore, apparent that there has been provided in accordance with the present invention, a developing device which can develop dot or screen pattern images with high reproductivity and high fidelity without degrading the quality of line and solid images. The present invention achieves an excellent reproduction of dot or screen pattern images by making the sleeve or toner carrier out of semiconductive material. It is to be noted that the sleeve may comprise a base member made of non-magnetic conductive material, the base member being coated with semiconductive material having a specific resistance ranging from $10^6$ to $10^{12}$ Ωcm. Test results show that the semiconductive coating layer should have a thickness equal to or greater than 500 μm to have a similar effect. In addition, a high-frequency bias voltage may be applied to achieve a high-quality dot pattern image reproduction. The bias voltage comprises a high-frequency AC voltage component superposed on a DC voltage component. The AC voltage component has a peak-to-peak value determined as a function of the length of the gap between the sleeve and the latent image carrier.

While the developing device of the present invention has been described above for use in conjunction with copying machines, nevertheless the developing device can be used for a variety of applications. For example, the developing device of the present invention can be used with a printer, in which case, the developing device develops electrostatic latent images formed on a dielectric member. While the present invention has been described in conjunction with specific embodiments thereof, it is evident that many alternatives, modifications and variations will be apparent to those skilled in the art. Accordingly, it is intended to embrace all alternatives, modifications and variations that fall within the scope of the appended claims.

What is claimed is:

1. A device for developing an electrostatic latent image recorded on a photoconductive layer, comprising:

a doner roll for supporting a uniform layer of single-component developing material adjacent to said photoconductive layer, said doner roll being disposed so as to create a space gap between said photoconductive layer and doner roll, said doner roll being made of semiconductive material having a specific resistance ranging from $10^6$ to $10^{12}$ Ωcm; and means for applying an electrical bias potential across said gap, thereby establishing a field for transferring said developing material from said doner roll to said photoconductive layer, said electrical bias potential including a high-frequency AC voltage having a peak-to-peak value ($V_{p-p}$) in volts in the following range:

$$6\,g+200 \leqq V_{p\text{-}p} > 10\,g+300$$

where g is the length in micrometers of said gap between said photoconductive layer and doner roll.

2. The developing device as claimed in claim 1, wherein said electrical bias potential includes an AC voltage component superposed on a DC voltage component.

3. The developing device as claimed in claim 1, wherein said AC voltage component has a frequency ranging from 1 kHz to 10 kHz.

4. The developing device as claimed in claim 3, wherein said AC voltage component has a frequency ranging from 1 kHz to 3 kHz.

* * * * *